United States Patent [19]

Economopoulos et al.

[11] Patent Number: 4,917,171

[45] Date of Patent: Apr. 17, 1990

[54] LUBRICATING A CONTINUOUS-CASTING MOLD

[75] Inventors: Marios Economopoulos, Liege; Raymond D'Haeyer, Barchon, both of Belgium

[73] Assignee: Centre de Recherches Metallurgiques-Centrum Voor Research in de Metallurgie, Brussels, Belgium

[21] Appl. No.: 728,193

[22] Filed: Apr. 29, 1985

[30] Foreign Application Priority Data

Apr. 27, 1984 [BE] Belgium ..... 899,544

[51] Int. Cl.[4] ..... B22D 11/07

[52] U.S. Cl. ..... 164/472; 164/268

[58] Field of Search ..... 164/472, 268

[56] References Cited

U.S. PATENT DOCUMENTS

| | | | |
|---|---|---|---|
| 2,747,244 | 5/1956 | Goss | 164/268 |
| 2,825,947 | 3/1958 | Goss | 164/472 |
| 4,369,832 | 1/1983 | Pryor et al. | 164/472 |

FOREIGN PATENT DOCUMENTS

| | | | |
|---|---|---|---|
| 2027375 | 4/1983 | United Kingdom | 164/472 |

*Primary Examiner*—Kuang Y. Lin

*Attorney, Agent, or Firm*—Fleit, Jacobson, Cohn, Price, Holman & Stern

[57] ABSTRACT

A lubricant is introduced through at least one orifice extending through the peripheral wall of a continuous casting mold. The lubricant melts and spreads between the peripheral wall and metal cast in the mold. The lubricant may be pre-heated.

3 Claims, 1 Drawing Sheet

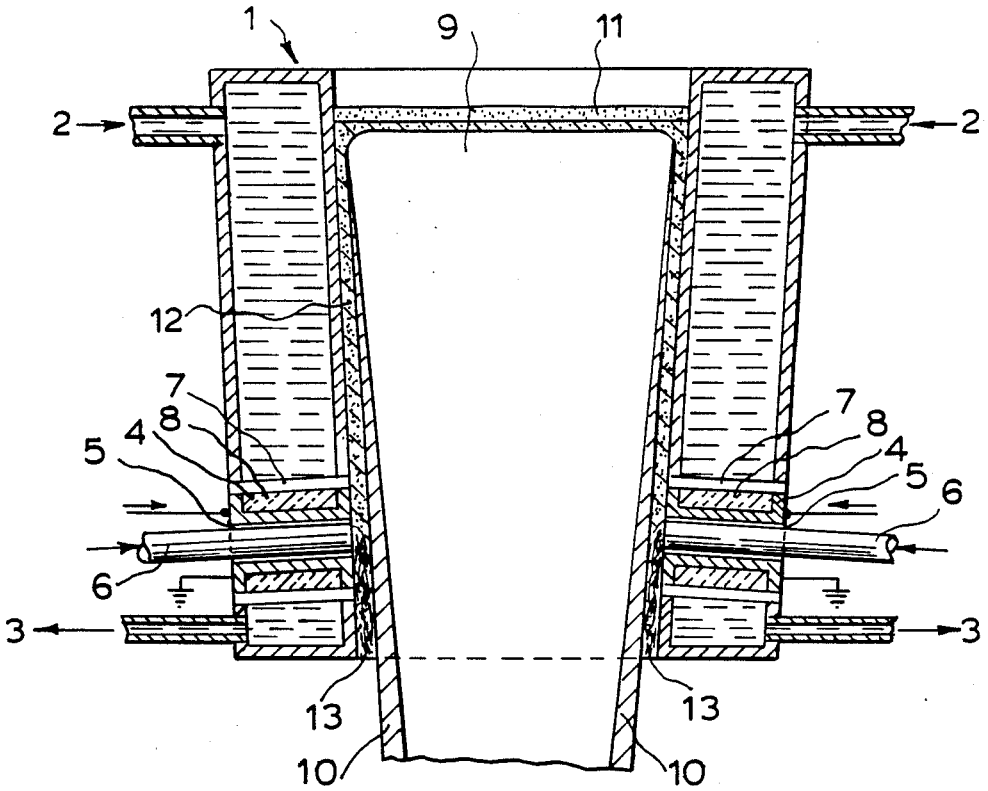
1
9
11
2
2
12
7
8
4
5
7
8
4
5
6
6
3
3
13
13
10
10

LUBRICATING A CONTINUOUS-CASTING MOLD

BACKGROUND TO THE INVENTION

1. Field of Invention

The invention relates to a method of lubricating a mold for continuously casting metal, more particularly steel.

As is known, in the method of continuously casting a metal, the liquid metal is poured into a bottomless mold, usually vibrated, whose peripheral wall is vigorously cooled. As a result of the vigorous cooling, a skin of cast metal quickly solidifies, after which the metal strand is extracted from the mold and travels through withdrawal rolls where solidification continues to completion.

When the metal begins to solidify in the mold, two solid surfaces are juxtaposed, one moving relative to the other. These two surfaces are at high, though different temperatures, and consequently there are serious problems of friction and therefore of lubrication in the contact zone.

2. Prior Art

Conventionally, a continuous-casting mold of the kind in question is lubricated by depositing a powder containing a suitable lubricant on the upper surface of the cast metal. The high temperature in the mold melts the powder, which, owing to the vibration of the mold, penetrates between the cast metal and the inner surface of the mold. It may happen, however, that the lubricant loses some or all of its properties, inter alia its fluidity, before reaching the lower end of the mold. This may occur e.g. because the molten powder entrains particles such as alumina inclusions from the cast metal. These particles, which are usually refractory, raise the melting-point of the powder, which solidifies irregularly so that the mold is no longer lubricated in a hydrodynamic manner.

Also, at the lower end of the mold, the cast metal has a solidified skin which is already of considerable thickness, i.e. the skin is cool compared with the molten metal. As a result, the vigorously-cooled mold wall is at a temperature appreciably below the melting point of the powder. The inner surface of the wall therefore becomes covered with a layer of solidified powder, which disadvantageously affects the film of lubricant and reduces its efficiency.

In the present state of the art, therefore, the lower part of a continuous casting mold is not always lubricated in a satisfactory manner, which may be a serious disadvantage with regard to the surface quality of the cast metal.

SUMMARY OF THE INVENTION

The invention relates to a method of obviating this disadvantage by ensuring additional lubrication, inter alia in the region near the lower end of the continuous-casting mold.

The invention provides a method in which at least one orifice is formed through the mold wall, a lubricant is introduced through the orifice, and the lubricant is melted so that it spreads between the mold wall and the metal cast in the mold.

Advantageously, the lubricant may be introduced in the form of a bar made up of powder having a melting-point below the temperature of the material near the orifice. Note that the said material can either be the already-solidified skin of the cast metal, or powder which has solidified on the inner surface of the mold wall. In the first case, the bar of lubricant melts and lubricates the mold. In the second case, the lubricant bar melts and also melts (or fluxes) the solidified powder, and the two molten powders mix and continue to lubricate the mold.

The lubricant may be pre-heated and, if required, is initially melted while in the orifice through the mold wall. In this connection it has been found advantageous to use the Joule effect for bringing about the pre-heating and/or melting.

The invention also provides apparatus for working the above-described method, comprising means for introducing and moving a lubricant through the mold wall, and means for thermally insulating the lubricant from the mold-cooling system.

The term "mold wall" refers to all the surfaces of the mold. Of course, without departing from the scope of the invention, one or if required a number of orifices can be formed through each surface, depending on the dimensions of the mold, to ensure that a lubricant film forms over the entire internal surface of the mold.

In a preferred embodiment, means are provided for heating and/or melting the lubricant. The heating and/or melting means may comprise a Joule-effect heating circuit.

BRIEF DESCRIPTION OF THE DRAWING

By way of illustration only, the accompanying drawing represents a continuous-casting mold, in vertical section.

DETAILED DESCRIPTION

A mould 1 has a cooling water circuit, diagrammatically indicated by arrows 2 and 3 indicating the inflow and outflow of water respectively. The water flows through a hollow peripheral wall comprising a number of side-walls. Two furnaces 4 disposed in two opposite side-walls have cylindrical orifices 5 through which round bars 6 of a lubricant can be inserted into the mold. The furnaces have a Joule-effect heating system, using an electric current I. They are separated from the cooling water by sealing-tight partitions 7, and are also surrounded with heat-insulating material 8 to avoid any premature heating of the cooling water.

When a liquid metal, e.g. molten steel, is poured into the mold, a solidified skin 10 forms at the periphery of the cast strand 9 and increases in thickness in the direction of advance of the strand. Powder 11 deposited on the top surface of the liquid metal melts and, as a result of the vibration of the mold, flows between the peripheral wall of mold 1 and the skin 10. In the illustrated example, the film 12 formed by the molten powder loses its lubricating power in the lower part of the mold. In this part, the bars 6 heated and melting in the furnaces 4 make up for the missing lubricant by forming a film 13 which ensures efficient lubrication as far as the mold outlet.

In a mold for continuously casting metal, more particularly steel, as a strand of rectangular or polygonal cross-section, each side-wall of the mold is preferably equipped with at least one lubricating device of the above-described kind.

We claim:

1. A method of providing lubrication to a continuous-casting mold comprising introducing a fusible solid lubricant through at least one orifice extending through a peripheral wall in the lower end region of the mold, preheating the lubricant before the lubricant enters the mold from the orifice and melting the solid lubricant while in the orifice so that it spreads between the lower end region of the peripheral wall and metal cast in the mold.

2. The method of claim 1, in which the lubricant is introduced in the form of a bar made up of powder having a melting-point below the temperature in the mold adjacent the orifice.

3. The method of claim 1, in which the pre-heating comprises Joule effect heating.

* * * * *